US006547412B2

(12) United States Patent
Piparo-Haase et al.

(10) Patent No.: US 6,547,412 B2
(45) Date of Patent: Apr. 15, 2003

(54) LIGHT EMITTING ACCESSORY FOR JEWELRY

(76) Inventors: Dawn A. Piparo-Haase, 1226 Chesterwood La., Pewaukee, WI (US) 53072; James A. Heyden, 4631 Sonsecahray Dr., Hubertus, WI (US) 53033

( * ) Notice: Subject to any disclaimer, the term of this patent is extended or adjusted under 35 U.S.C. 154(b) by 0 days.

(21) Appl. No.: 09/844,552

(22) Filed: Apr. 27, 2001

(65) Prior Publication Data

US 2001/0038533 A1 Nov. 8, 2001

Related U.S. Application Data

(60) Provisional application No. 60/204,857, filed on May 16, 2000.

(51) Int. Cl.[7] ..... F21V 21/08

(52) U.S. Cl. ..... 362/104; 362/571; 362/208; 362/205; 362/202

(58) Field of Search ..... 362/104, 571, 362/186, 208, 189, 205, 203, 202

(56) References Cited

U.S. PATENT DOCUMENTS 4,309,743 A * 1/1982 Martin ..... 362/104
5,876,109 A * 3/1999 Scalco ..... 362/104
6,122,933 A * 9/2000 Ohlund ..... 63/3

* cited by examiner

*Primary Examiner*—Sandra O'Shea
*Assistant Examiner*—Ronald E. Delgizzi
(74) *Attorney, Agent, or Firm*—Donald J. Ersler

(57) ABSTRACT

A light emitting accessory includes a tube, a switch cap, a light source, a ballast, and at least one battery. The switch cap is threadably engagable with the tube. The at least one battery and light source are retained by the ballast. The switch cap is rotated to close an electrical circuit between the at least one battery and the light source. In a second embodiment, the light emitting accessory includes a switch cap, base tube, light assembly, and at least one battery. The switch cap is threadably engagable to the base tube. The at least one battery and the light assembly are retained by the base tube. Rotation of the switch cap will close an electrical circuit between the at least one battery and at least one light emitting device of the light assembly. In a third embodiment, the light emitting accessory includes a decorative case, a light assembly, and at least one battery. The light assembly is retained in the decorative case. A cantilever member is preferably formed in the back plate for depressing an on-off switch on the light assembly.

15 Claims, 9 Drawing Sheets

LIGHT EMITTING ACCESSORY FOR JEWELRY

CROSS-REFERENCES TO RELATED APPLICATIONS

This is a utility application taking priority from provisional application, Ser. No. 60/204,851 filed on May 16, 2000.

BACKGROUND OF THE INVENTION

1. Field of the Invention

The present invention relates generally to jewelry and more specifically to a light emitting accessory for jewelry which enhances the appearance of the jewelry.

2. Discussion of the Prior Art

Although there are many forms of jewelry, it appears that a light emitting type does not exist. A light emitting accessory would be visible at night and enhance the appearance of the jewelry.

Accordingly, there is a clearly felt need in the art for a light emitting accessory for jewelry which enhances the appearance of the jewelry.

SUMMARY OF THE INVENTION

The present invention provides a light emitting accessory for jewelry which may be viewed at night. The light emitting accessory includes a tube, a switch cap, a light source, a ballast, and at least one battery. The tube is preferably fabricated from a translucent or clear material. External threads are formed on a first end of the tube. At least one slot is cut into a first end of the tube. A cavity is formed in a first end of the ballast which is sized to receive the at least one battery. A positive lead and a negative lead are preferably formed within the ballast. A first end of the positive lead extends into the cavity and the second end extends out a second end of the ballast. A first end of the negative lead extends from a periphery of the ballast and the second end extends out a second end of the ballast.

The leads of the light source are attached to the second ends of the positive and negative leads. The ballast is inserted into the first end of the tube. The at least one battery is inserted into the cavity in the ballast. The inner diameter of the switch cap is threaded to receive the threads on the first end of the tube. A spring extends from an inside of the switch cap. To illuminate the tube, the switch cap is threaded on to the tube until the switch cap contacts the negative lead and the spring contacts the at least one battery. Electrical current travels through the negative lead, spring, battery, and positive lead, to cause the light source to emit light. A translucent jewel or an attachable ornament may be attached to a bottom of the tube. The spring may be replaced with an elastic member located below the battery.

In a second embodiment, the light emitting accessory includes a switch cap, base tube, light assembly, and at least one battery. The switch cap is preferably threaded on an inside diameter and the base tube is preferably threaded on an outside diameter. A battery bore is formed in a first end of the base tube to receive the at least one battery and a light bore is formed in a second end thereof to receive the light assembly. A pass through opening is formed through the battery and light bores. An elastic member is preferably inserted into a bottom of the battery bore. A light assembly includes a ballast which retains at least one light emitting device. A first contact is formed on one end of the ballast and a second contact is formed on a side of the ballast. The first contact is connected to one lead of the at least one light emitting device and the second contact is connected to the other lead thereof. A protective lens is preferably formed over the other end of the ballast to protect the at least one light emitting device. A current interrupting device may be included to make the at least one light emitting device provide flashing light.

Rotation of the switch cap will cause the at least one battery to compress the elastic member and make electrical contact with the first contact. The battery will provide electrical current to the at least one light emitting device. The second contact is electrically connected to the base tube. Electrical current will flow through the base tube, the switch cap and back to a ground of the at least one battery. The at least one light emitting device will emit light. The current interrupting device may be included to make the at least one light emitting device emit a flashing light. A light tube may be attached to the base tube to enhance the light effect of the light emitting accessory.

In a third embodiment, the light emitting accessory includes a decorative case, a light assembly, and at least one battery. The light assembly includes an on-off switch and, at least one light emitting device formed on a ballast. The ballast preferably retains the at least one battery with a spring clip. One pole of the on-off switch is electrically connected to one pole of the battery and the other pole of the on-off switch is electrically connected to one lead of the at least one light emitting device. The other lead of the at least one light emitting device and the other pole of the at least one battery are electrically connected to each other. The on-off switch opens and closes an electrical current path between the at least one battery and the at least one light emitting device.

The decorative case preferably includes a face member and a back plate. The face member is fabricated from a clear or translucent material. A cantilever member is preferably formed in the back plate. An end of the cantilever member is disposed such that depressing the cantilever member toggles the on-off switch. A current interrupting device may be included to make the at least one light emitting device provide flashing light.

Accordingly, it is an object of the present invention to provide a light emitting accessory which acts as a piece of jewelry, yet emits light for viewing at night.

These and additional objects, advantages, features and benefits of the present invention will become apparent from the following specification.

DETAILED DESCRIPTION OF THE PREFERRED EMBODIMENTS

Figure 1:
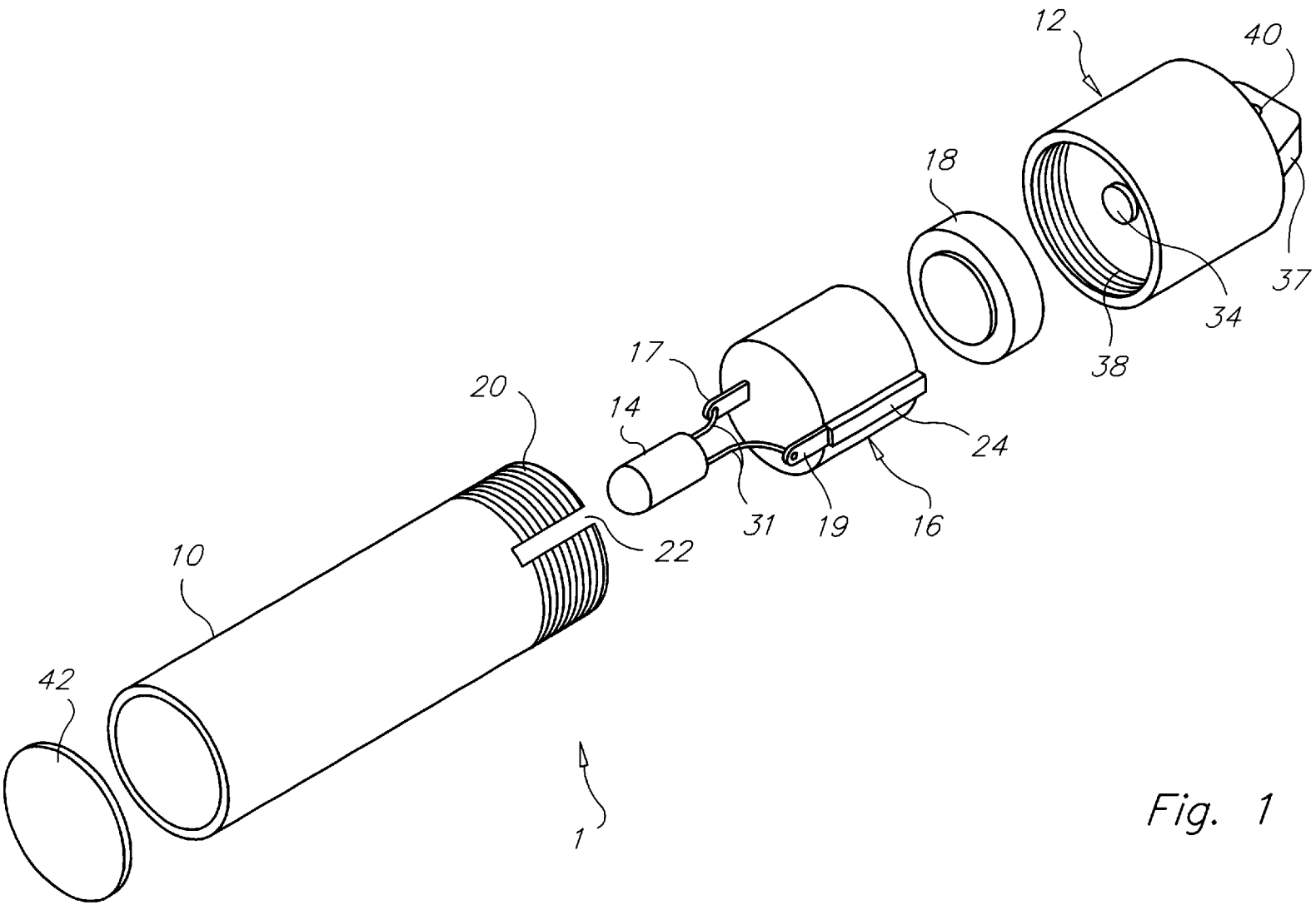
FIG. 1 is an exploded perspective view of a light emitting accessory for jewelry in accordance with the present invention.

With reference now to the drawings, and particularly to FIG. 1, there is shown a perspective view of a light emitting accessory for jewelry 1. With reference to FIGS. 2–5, the light emitting accessory for jewelry 1 includes a tube 10, a switch cap 12, a light source 14, a ballast 16, and at least one battery 18. The tube 10 is preferably fabricated out of a translucent or clear plastic. The tube 10 could also be fabricated from glass or any other material which has translucent or clear optical qualities. The color of the tube 10 may be clear or any other color of the light spectrum. External threads 20 are formed on a first end of the tube 10. At least one slot 22 is cut into a first end of the tube 10.

The ballast 16 has an outside body which is sized to be received by an inside diameter of the tube 10. At least one tab 24 extends from an outside periphery of the ballast 16. The at least one tab 24 is sized to be received by the at least one slot 22. A cavity 26 is formed in a first end of the ballast 16. The depth of the cavity 26 is preferably less than the height of the at least one battery 18 to allow thereof to be easily removed from the ballast 16. Preferably, at least three standoffs 27 are formed within the wall of the cavity 26. The periphery formed by the inside surfaces of the at least three standoffs 27 are sized to slidably receive the at least one battery 18.

A positive lead 17 is formed through a second end of the ballast 16. A first end of the positive lead 17 protrudes into the cavity 26 and is bent over such that the positive terminal of the battery 18 may contact thereof. A second end of the positive lead 17 protrudes out the second end of the ballast 16. A positive lead hole 28 is preferably formed through a second end of the positive lead 17. The positive lead hole 28 is sized to receive one lead of the light source 14. A negative lead 19 is preferably molded into a side of the ballast 16. A first end of the negative lead 19 is attached to a top of the at least one tab 24. A second end of the negative lead 19 protrudes out the second end of the ballast 16. A negative lead hole 30 is preferably formed through a second end of the negative lead 19. The negative lead hole 30 is sized to receive the other lead of the light source 14. The leads 31 of the light source 14 are preferably soldered to the positive and negative leads.

Figure 2:
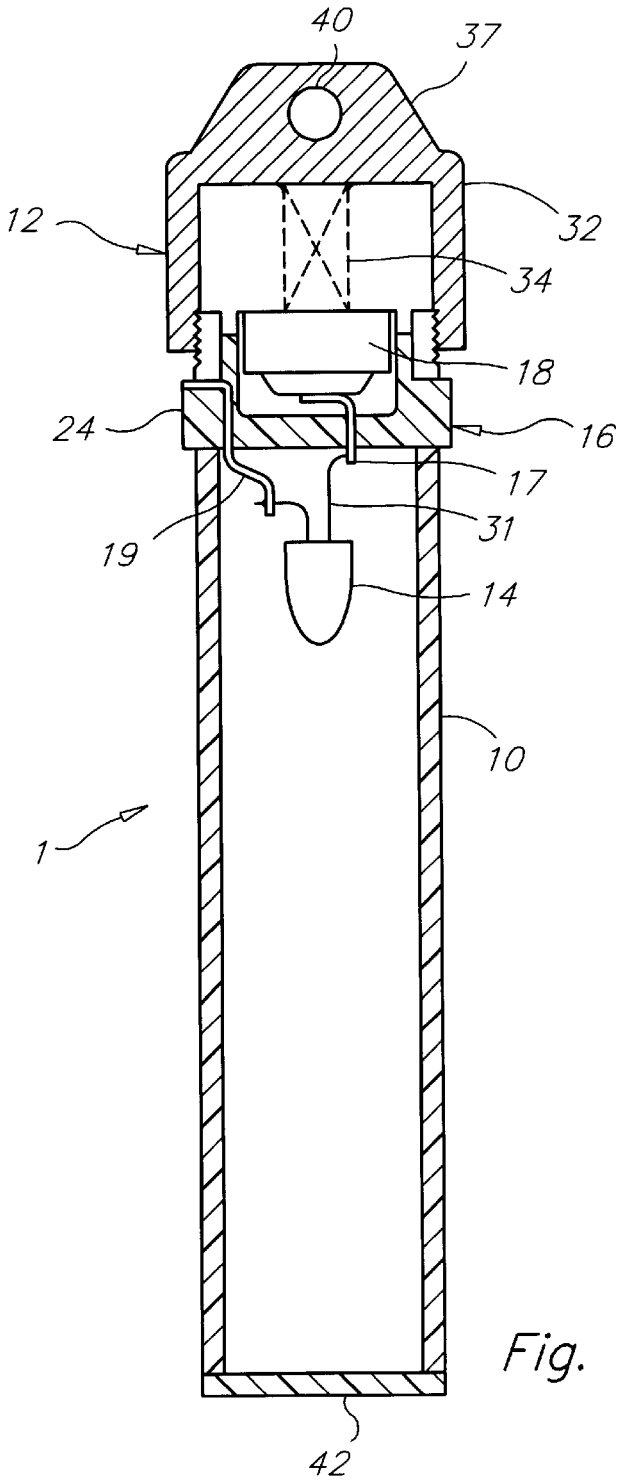
FIG. 2 is a cross sectional view of a light emitting accessory for jewelry in accordance with the present invention.
Figure 2A:
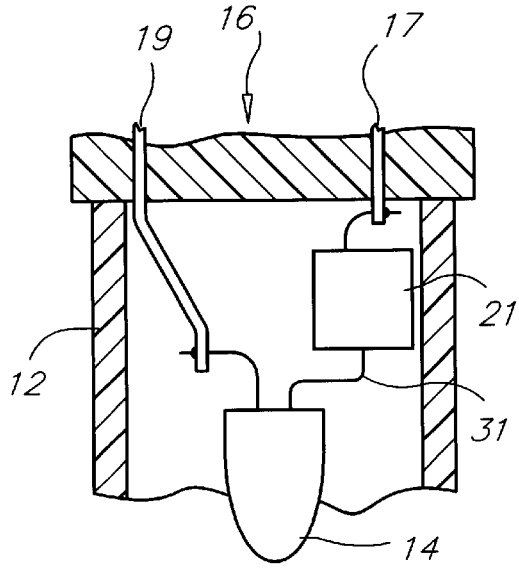
FIG. 2*a* is a partial cross sectional view of a light emitting accessory for jewelry with intermittent illumination in accordance with the present invention.
Figure 3:
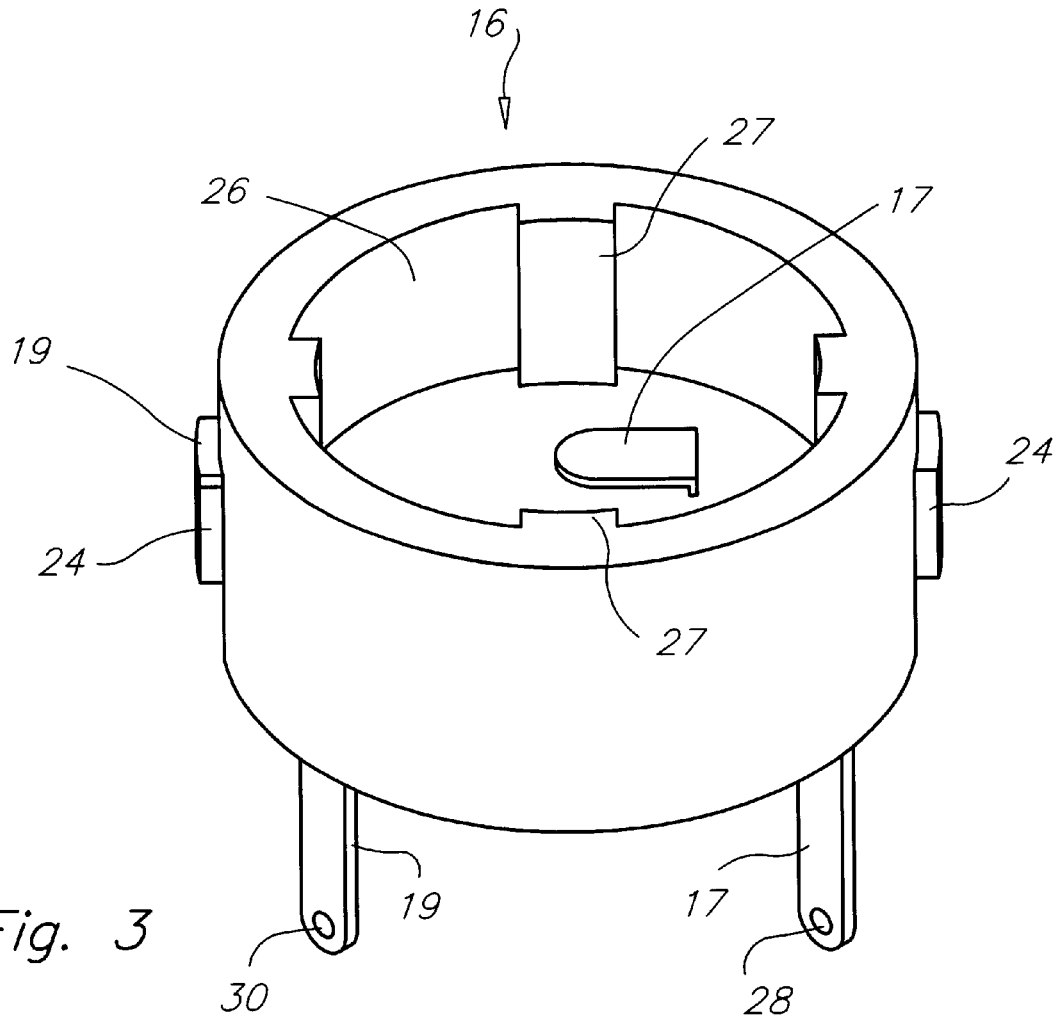
FIG. 3 is a perspective view of a ballast from a light emitting accessory for jewelry in accordance with the present invention.
Figure 4:
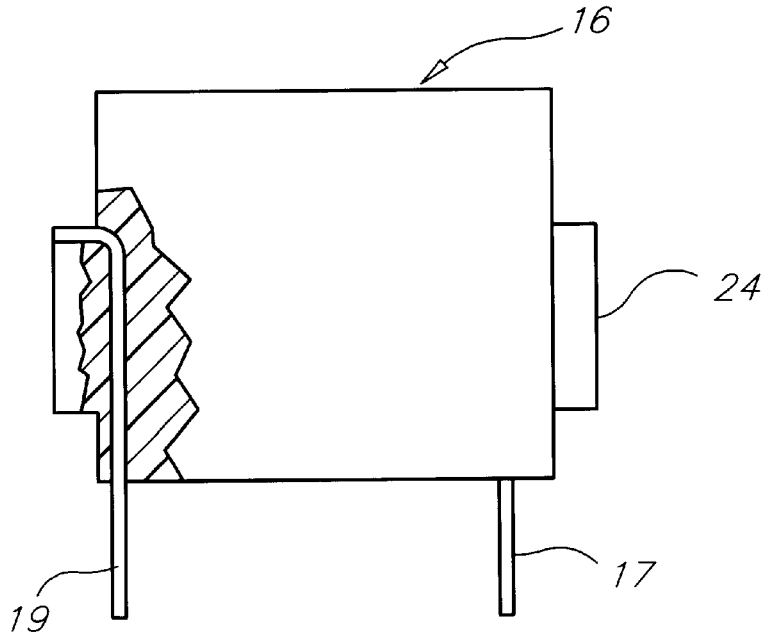
FIG. 4 is a side view of a ballast from a light emitting accessory for jewelry in accordance with the present invention.
Figure 5:
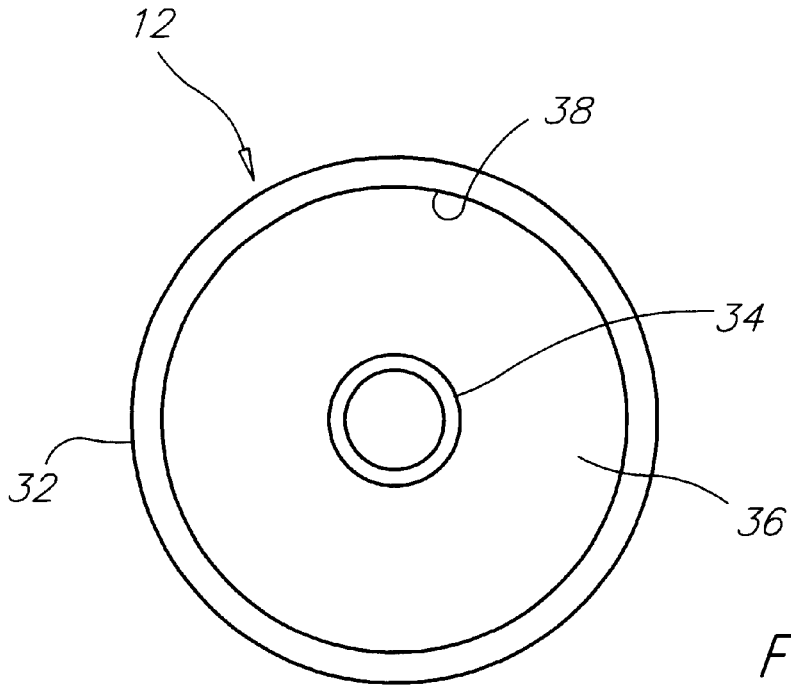
FIG. 5 is a bottom view of a switch cap from a light emitting accessory for jewelry in accordance with the present invention.

FIG. 2*a* shows a current interrupting device 21 placed between the light source 14 and the positive terminal 17. The current interrupting device 21 prevents the flow of electrical current to the light source 14 in a periodic fashion. The interruption of current makes the light source flash 14. The current interrupting device 21 could be a bi-metal contact, an electronic device, or any other suitable device which interrupts the flow of current to the light source. The current interrupting device 21 could be placed anywhere in the light source electrical circuit including the position shown in FIG. 2*a*.

The switch cap 12 includes a body 32 and a conductive spring 34. A bore 36 is formed inside the body 32 on a first end. The body is preferably fabricated from an electrically conductive material, but the bore 36 and the first end may also be coated with a conductive coating. Preferably, internal threads 38 are formed on an inside of the bore 36. The internal threads 38 are threadably engagable with the external threads 20 formed on the first end of the tube 10. The conductive spring 34 extends from a bottom of the bore 36. The conductive spring 34 is attached and electrically conductive to the bottom of the bore 36 with any suitable method. A flange 37 extends from a second end of the body 32. A hole 40 is preferably formed through the flange 37 to allow attachment to a piece of jewelry.

Figure 6:
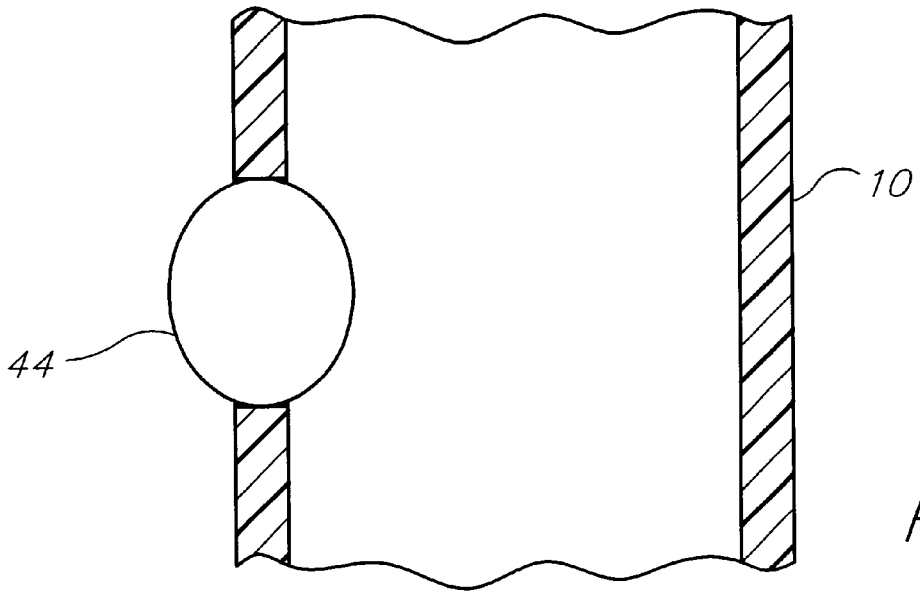
FIG. 6 is a cross-sectional view of a jewel formed as an integral part of a tube wall in accordance with the present invention.

A second end of the tube 10 is preferably terminated with an opaque cover 42. The opaque cover 42 prevents light from escaping through the second end of the tube 10. With reference to FIG. 6, a jewel 44 is inserted through and attached to a side wall of the tube 10. The jewel 44 is preferably translucent or clear to allow light to shine therethrough. The tube 10 may be fabricated from an opaque material if the jewel 44 is included with the light emitting accessory 1.

Figure 7:
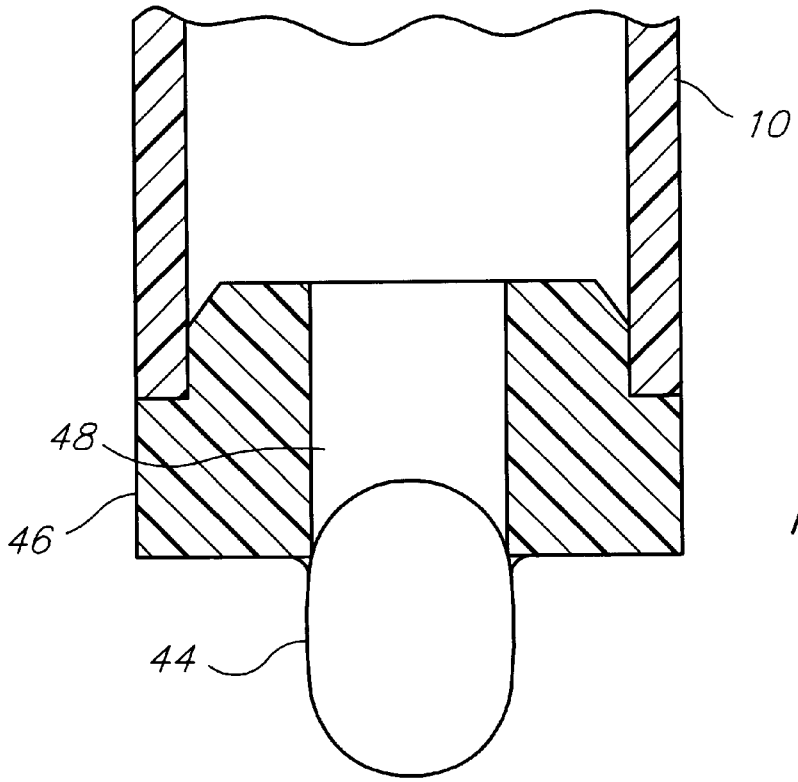
FIG. 7 is a cross-sectional view of a jewel base inserted into a bottom of a tube in accordance with the present invention.

FIG. 7 shows an alternative to that of FIG. 6, the jewel 44 is inserted into and attached to a plug 46. The plug 46 is inserted into the inner diameter of the tube 10. A bore 48 is formed through the plug 46 which allows light to shine into the jewel 44. The outer diameter of the plug 46 is sized to be received by an inside diameter of the tube 10 at a second end thereof. The plug 46 may be attached to the tube 10 with adhesive or by providing a press fit between the inside diameter of the tube 10 and the outside diameter of the of the plug 46 at the second end thereof.

Figure 8:
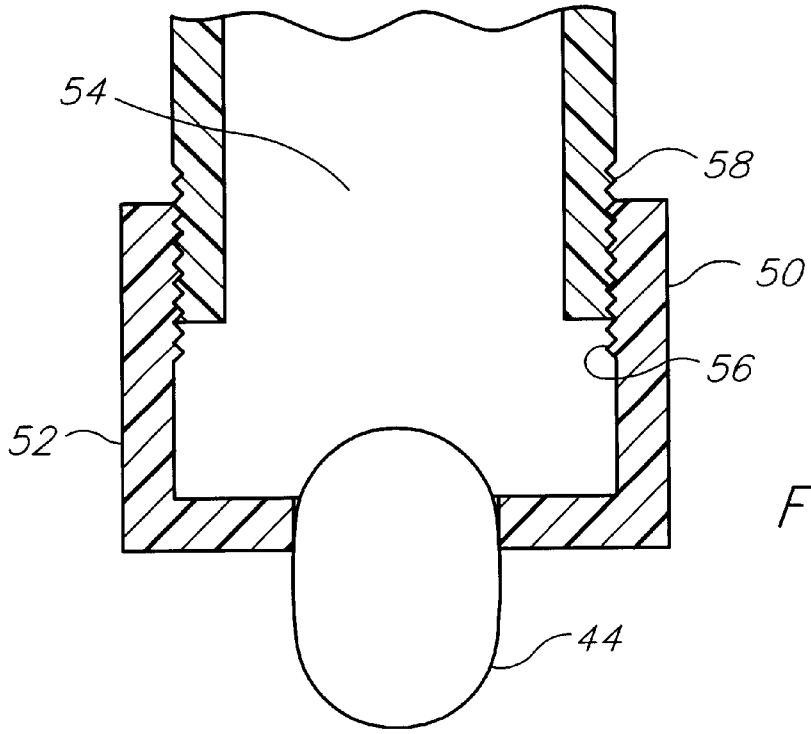
FIG. 8 is a cross-sectional view of a jewel base threaded on to a bottom of a tube in accordance with the present invention.

FIG. 8 discloses a jewel housing 50. The jewel housing 50 includes a body 52 and the jewel 44. A bore 54 is formed inside the body 52 on a first end. Internal threads 56 are formed on the wall of bore 54. The internal threads 56 are threadably engagable with external threads 58 formed on a second end of the tube 10.

Figure 9:
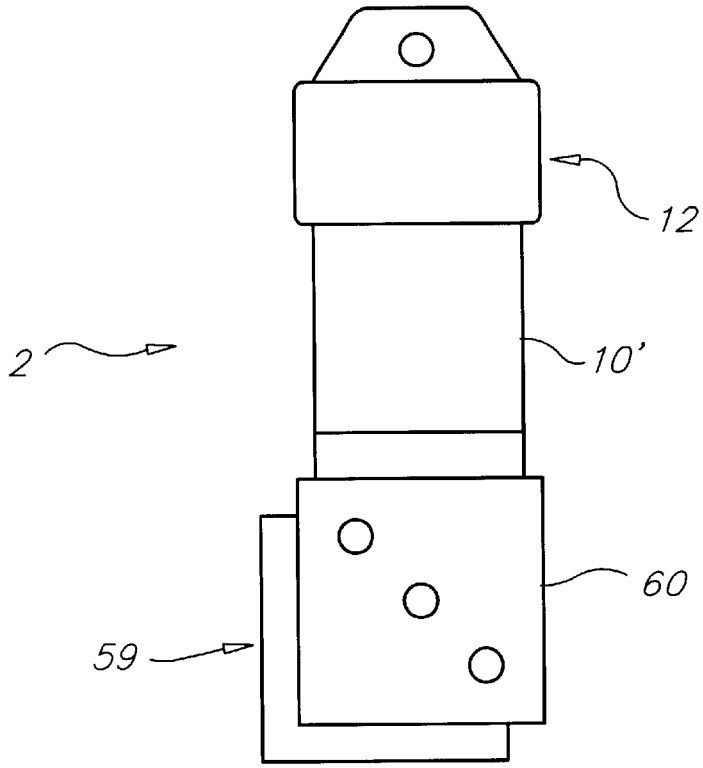
FIG. 9 is a front view of a light emitting accessory for jewelry which has a pair of dice attached to a bottom thereof in accordance with the present invention.
Figure 9A:
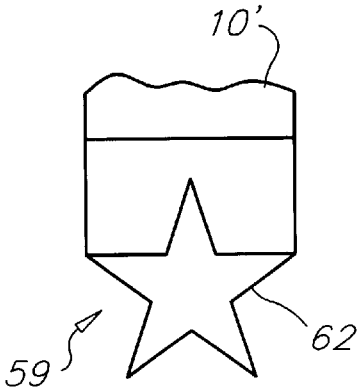
FIG. 9*a* is a partial front view of a light emitting accessory for jewelry which has a star attached to a bottom thereof in accordance with the present invention.
Figure 9B:
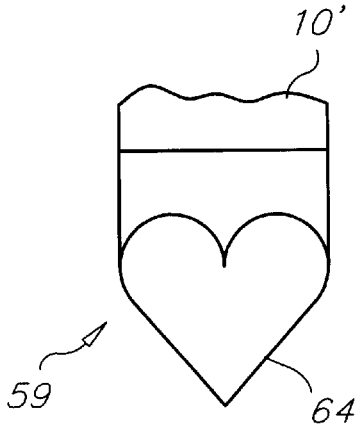
FIG. 9*b* is a partial front view of a light emitting accessory for jewelry which has a heart attached to a bottom thereof in accordance with the present invention.
Figure 9C:
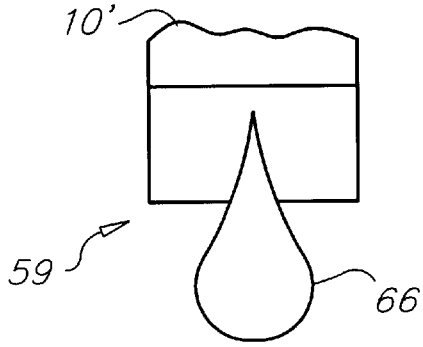
FIG. 9*c* is a partial front view of a light emitting accessory for jewelry which has a tear drop attached to a bottom thereof in accordance with the present invention.

FIGS. 9–9*c* disclose a light emitting accessory for jewelry 2. The light emitting accessory 2 includes a reduced length tube 10' and an attachable ornament 59. The attachable ornament 59 could be a pair of dice 60, a star 62, a heart 64, a tear drop 66, or any other ornament. The attachable ornament 59 is clear or translucent to allow light to illuminate thereof. The tube 10' has a reduced length such that more light illuminates through the attachable ornament 59, if the tube 10' is clear or translucent. The attachable ornament 59 may be fastened to an end of the tube 10' by inserting the attachable ornament 59 to a plug 46 and then inserting the plug 46 into an end of the tube 10'; fastening the attachable ornament 59 to a housing 50; or fastening the attachable ornament 59 directly to the end of the tube 10' with any suitable assembly method.

To illuminate the tube 10, jewel 44, or attachable ornament 59, the switch cap 12 is threaded on to the first end of the tube 10 until the switch cap 12 contacts the negative lead 19 and the conductive spring 34 contacts the at least one battery 18. Electrical current travels through the negative lead 19, conductive spring 34, at least one battery 18, and positive lead 17, to cause the light source 14 to emit light.

Figure 10:
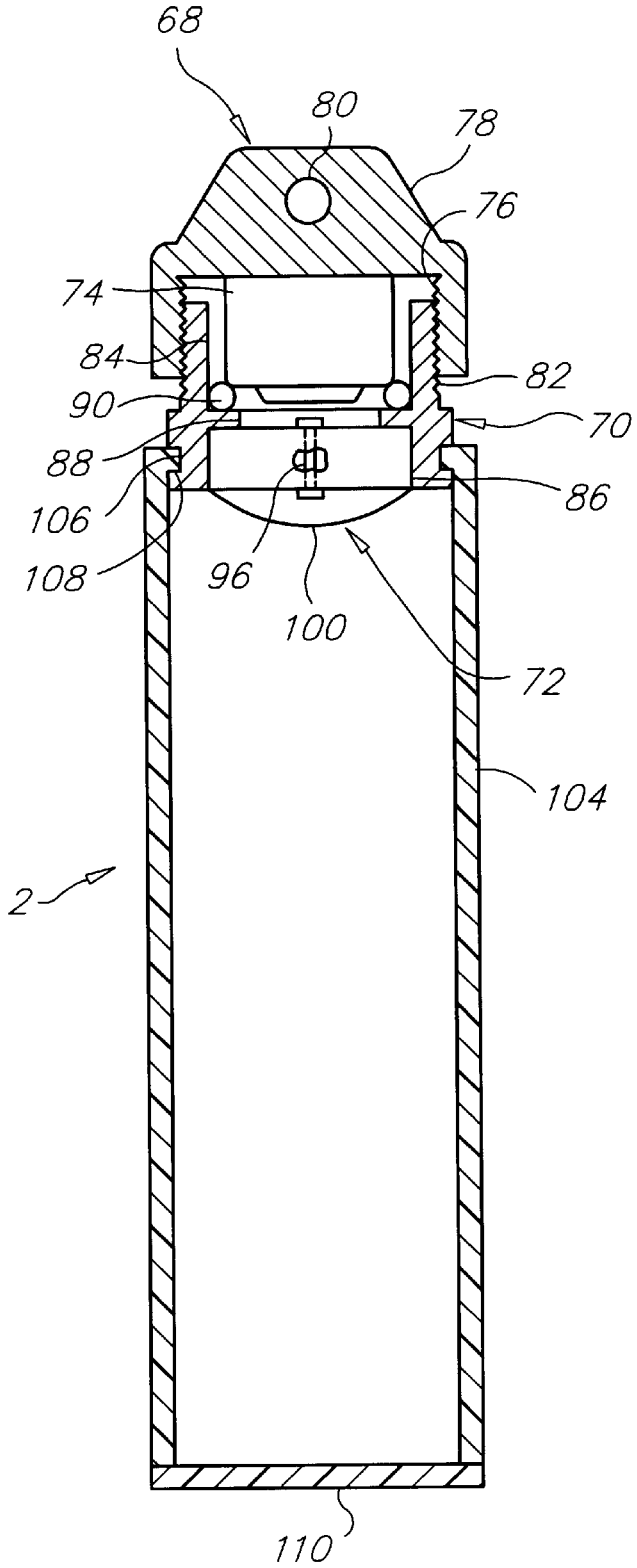
FIG. 10 is a cross sectional view of a second embodiment of a light emitting accessory in accordance with the present invention.
Figure 11:
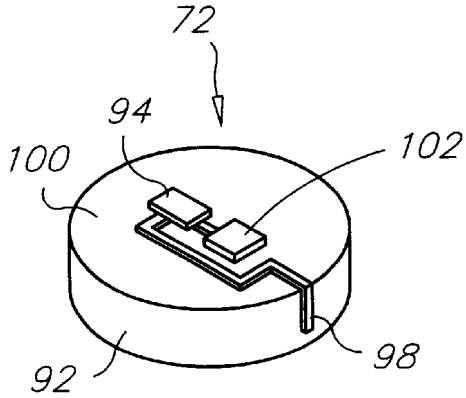
FIG. 11 is an enlarged perspective view of a light assembly of a second embodiment of a light emitting accessory in accordance with the present invention.

With reference to FIGS. 10 and 11, a second embodiment of the light emitting accessory 2 includes a switch cap 68, base tube 70, light assembly 72, and at least one battery 74. The switch cap 68 and base tube 70 are fabricated from an electrically conductive material. A threaded bore 76 is formed in one end of the switch cap 68. A chain flange 78 is preferably formed on the other end of the switch cap 68 with a chain opening 80 formed therethrough. The base tube 70 has an external thread 82 formed on an outer diameter thereof. The external thread 82 is threadably enagable with the threaded bore 76. A battery bore 84 is formed in a first end of the base tube 70 to receive the at least one battery 74 and a light bore 86 is formed in a second end thereof to receive the light assembly 72. A passthrough opening 88 is formed through the battery and light bores. An elastic member 90 is preferably inserted into a bottom of the battery bore 84.

A light assembly 72 includes a ballast 92 which retains at least one light emitting device 94. The ballast 92 is a nonconductive substrate with electrical circuitry attached thereto. The ballast 92 is sized to be received by the light bore 86. The at least one light emitting device 94 may be any suitable micro light emitting device. A first contact 96 is preferably formed through the ballast 92 and is electrically connected to one lead of the light emitting device 94. A second contact 98 is formed on a side of the ballast and is electrically connected to the other lead of the at least one light emitting device 94. A protective lens 100 is preferably formed over the ballast 92 to protect the light emitting device 94. The protective lens 100 is fabricated from a clear or translucent material.

Rotation of the switch cap 68 will force the at least one battery 74 to compress the elastic member 90 and make electrical contact with the first contact 96. The at least one battery 74 will provide electrical current to the at least one light emitting device 94. The second contact is electrically connected to the base tube 70. Electrical current will flow through the base tube 70, the switch cap 68 and back to a ground of the at least one battery 74. The at least one light emitting device 94 will emit light. A current interrupting device 102 may be included to make the at least one light emitting device 94 provide flashing light.

A light tube 104 may be attached to the base tube 70 to enhance the light effect of the light emitting accessory 2. The light tube 104 may be attached by forming a groove 106 in outer perimeter of the base tube 70 and forming at least two inward facing projections 108 on a top of the light tube 104. The light tube 104 may be terminated with an end cap 110 or with any device shown in FIGS. 7, 8, or 9–9*c*. The light tube 104 may also be modified as shown in FIG. 6.

Figure 12:
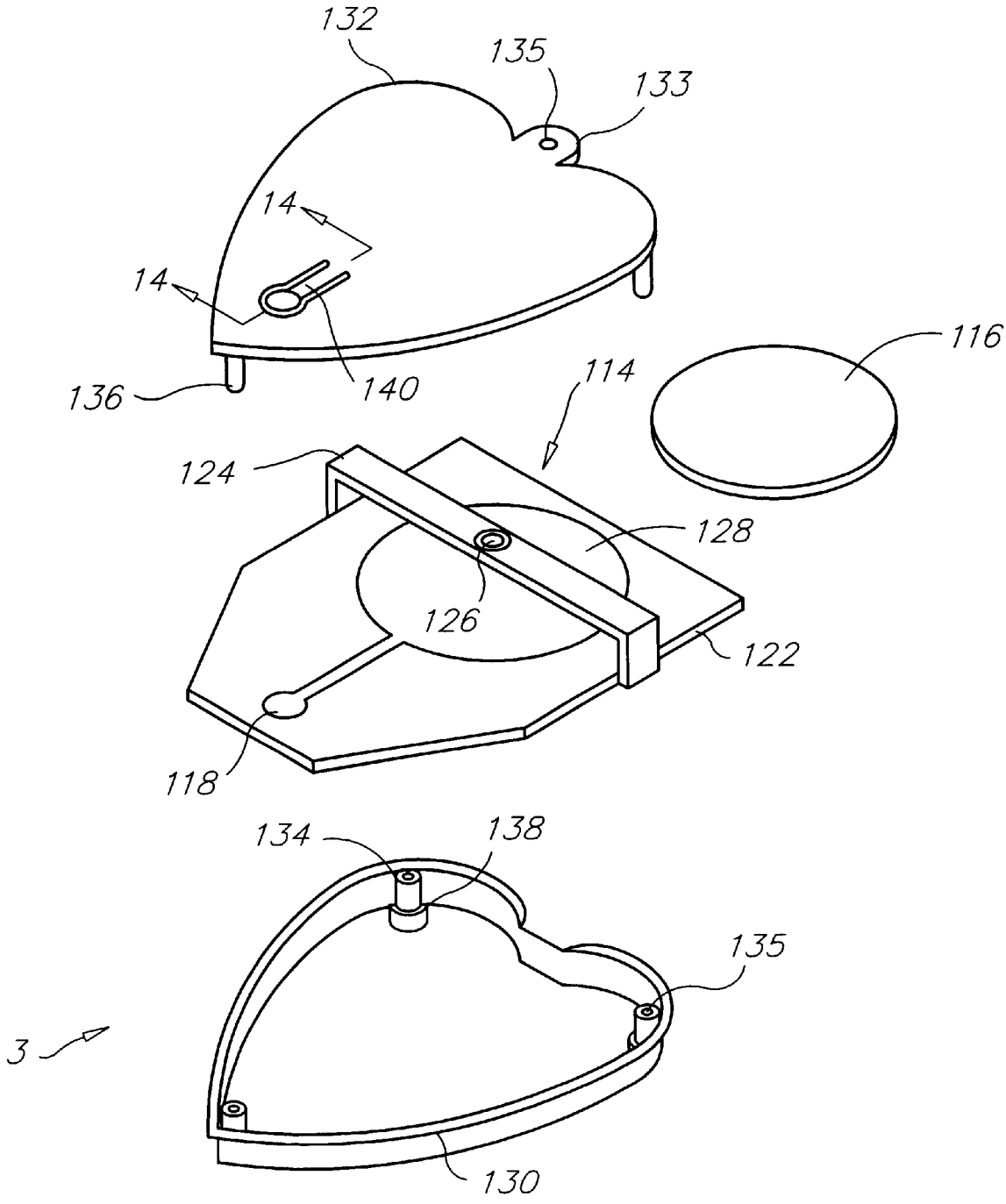
FIG. 12 is an exploded perspective view of a third embodiment of a light emitting accessory in accordance with the present invention.
Figure 13:
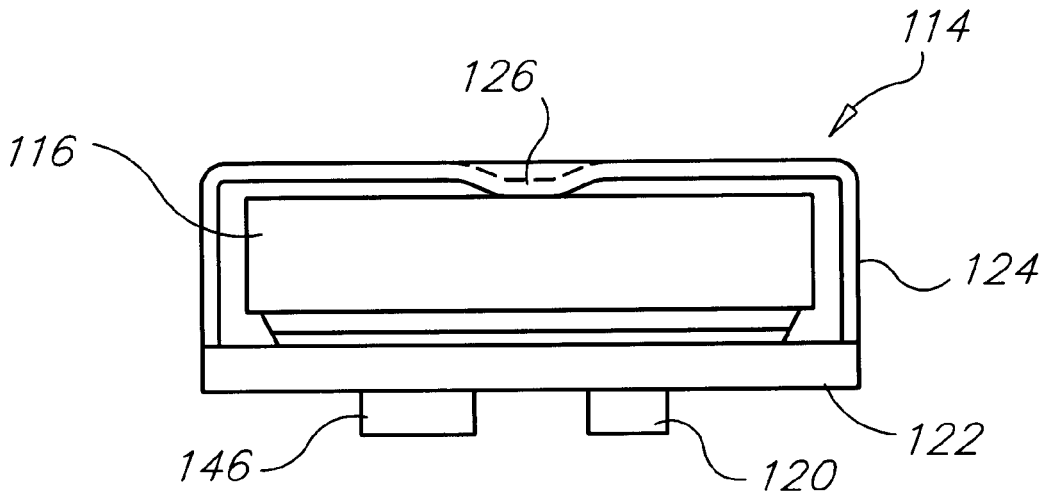
FIG. 13 is an end view of a ballast of a third embodiment of a light emitting accessory in accordance with the present invention.
Figure 14:
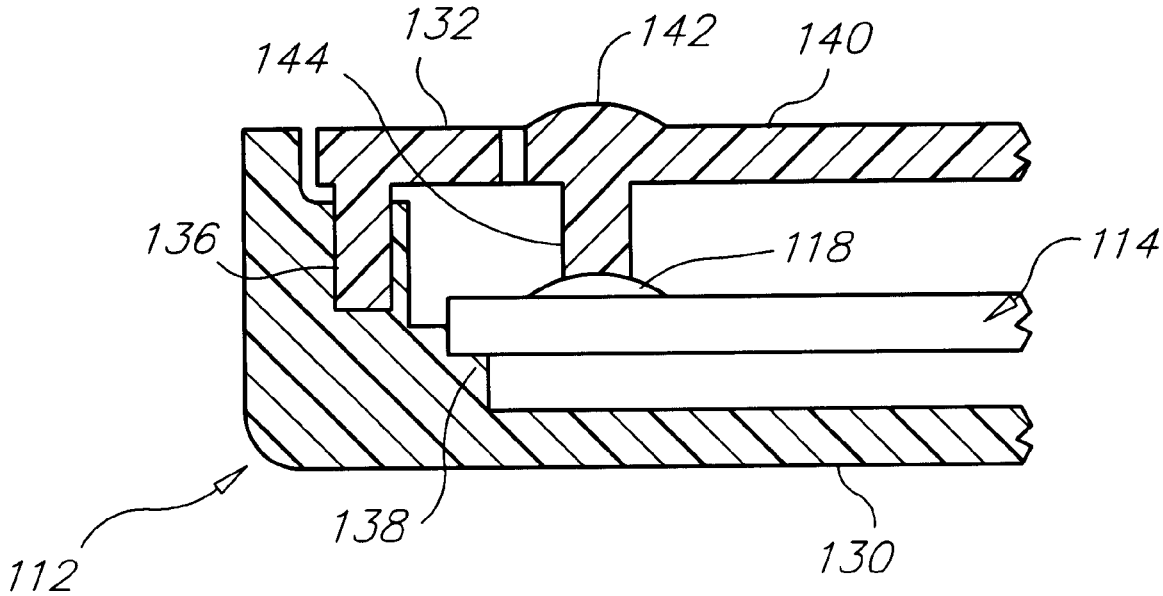
FIG. 14 is an enlarged cross sectional view of a third embodiment of a light emitting accessory in accordance with the present invention.

With reference to FIGS. 12–14, a third embodiment of the light emitting accessory 3 includes a decorative case 112, a light assembly 114, and at least one battery 116. The light assembly 114 includes an on-off switch 118 and, at least one light emitting device 120 formed on a ballast 122. The ballast 122 is preferably a double sided circuit board. The ballast 122 preferably retains the at least one battery 116 with a conductive spring clip 124. The conductive spring clip 124 is mechanically attached to the ballast 122 and electrically connected to one lead of the at least one light emitting device 120. A contact projection 126 is formed on a top of the conductive spring clip 124 to make electrical contact with one of the poles of the at least one battery 116.

One pole of the on-off switch 118 is electrically connected to one pole of the at least one battery 116 and the other pole of the on-off switch 118 is electrically connected to the other lead of the at least one light emitting device 120. The on-off switch 118 opens and closes an electrical current path between the at least one battery 116 and the light emitting device 120. A conductive pad 128 is preferably formed on a top of the ballast 122 to make contact with the at least one battery 116. The conductive pad 128 is electrically connected to the one pole of the on-off switch 118. Micro electric circuitry and micro on-off switches which are used in the fabrication of the light assembly 114 are well known in the art.

The decorative case 112 preferably includes a face member 130 and a back plate 132. The decorative case is preferably formed into an attractive shape such as a heart. The face member 130 is fabricated from a clear or translucent material. Preferably, the face member 130 has a depth which is sufficient to receive the light assembly 114. At least two female retention posts 134 are preferably formed in the inner perimeter of the face member 130. At least two projections 136 extend from the back plate 132. An opening 135 in each female retention post 134 is sized to receive each of projection 136. A standoff 138 may be formed on a side of each female retention post 134 to support the light assembly 114. A chain flange 133 may be formed on an end of the back plate 132. A chain hole 135 is formed through the chain flange 133.

A cantilever member 140 is preferably formed in the back plate 132. A raised portion 142 is preferably formed on an end of the cantilever member 140 to provide a reference point to depress. A switch projection 144 is formed on the side opposite the raised portion 142. Pressing the raised portion 142 causes the switch projection 144 to toggle the on-off switch 118. A current interrupting device 146 may be included to make the at least one light emitting device 120 provide flashing light.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A light emitting accessory for jewelry comprising:

at least one battery;

a light assembly including an on-off switch and at least one light emitting device, toggling of said on-off switch making an electrical connection between said battery and said at least one light emitting device; and a case including a back plate and a face member, said back plate including a cantilever member, a switch projection extending from an end of said cantilever member, said switch projection being disposed adjacent said on-off switch, wherein depressing said cantilever member over said switch projection causing said on-off switch to toggle; and said face member receiving said back plate, said case retaining said light assembly when said back plate is attached to said face member.

2. The light emitting accessory for jewelry of claim 1 wherein said face member being fabricated from a clear or translucent material.

3. The light emitting accessory for jewelry of claim 1, further comprising:

at least two retention posts being formed in an inner perimeter of said face member, at least two projections extending from said back plate, an opening being formed in each retention post which are sized to firmly receive one of said projections.

4. The light emitting accessory for jewelry of claim 3, further comprising:

a standoff being formed on each one of said at least two retention posts, said standoff receiving said light assembly.

5. The light emitting accessory for jewelry of claim 1, further comprising:

a conductive spring clip being attached to said light assembly and being electrically connected to said at least one light emitting device, said conductive spring clip retaining said battery and making electrical contact therewith.

6. The light emitting accessory for jewelry of claim 1, further comprising:

a current interrupting device preventing the flow of electrical current to said at least one light emitting device in a periodic fashion, the interruption of current causing said light emitting device to flash.

7. A light emitting accessory for jewelry comprising:

at least one battery;

a light assembly including an on-off switch and at least one light emitting device, toggling of said on-off switch making an electrical connection between said battery and said at least one light emitting device; and a case including a back plate and a face member, said back plate including a cantilever member, a switch projection extending from an end of said cantilever member, said switch projection being disposed adjacent said on-off switch, at least two projections extending from said back plate, wherein depressing said cantilever member over said switch projection causing said on-off switch to toggle; and said face member having at least two retention posts being formed in an inner perimeter of said face member, an opening being formed in each retention post which are sized to firmly receive one of said projections, said case retaining said light assembly when said back plate is attached to said face member.

8. The light emitting accessory for jewelry of claim 7 wherein:

said face member being fabricated from a clear or translucent material.

9. A The light emitting accessory for jewelry of claim 7, further comprising:

a standoff being formed on each one of said at least two retention posts, said standoff receiving said light assembly.

10. The light emitting accessory for jewelry of claim 7, further comprising:

a conductive spring clip being attached to said light assembly and being electrically connected to said at least one light emitting device, said conductive spring clip retaining said battery and making electrical contact therewith.

11. The light emitting accessory for jewelry of claim 7, further comprising:

a current interrupting device preventing the flow of electrical current to said at least one light emitting device in a periodic fashion, the interruption of current causing said light emitting device to flash.

12. A light emitting accessory for jewelry comprising:

at least one battery;

a light assembly including an on-off switch and at least one light emitting device, toggling of said on-off switch making an electrical connection between said battery and said at least one light emitting device; and a case including a back plate and a face member, said back plate including a cantilever member, a switch projection extending from an end of said cantilever member, said switch projection being disposed adjacent said on-off switch, at least two projections extending from said back plate, wherein depressing said cantilever member over said switch projection causing said on-off switch to toggle; and said face member receiving said back plate, at least two retention posts being formed in an inner perimeter of said face member, an opening being formed in each retention post which are sized to firmly receive one of said projections, a standoff being formed on each one of said at least two retention posts, said standoff receiving said light assembly, said case retaining said light assembly when said back plate is attached to said face member.

13. The light emitting accessory for jewelry of claim 12 wherein:

said face member being fabricated from a clear or translucent material.

14. The light emitting accessory for jewelry of claim 12, further comprising:

a conductive spring clip being attached to said light assembly and being electrically connected to said at least one light emitting device, said conductive spring clip retaining said battery and making electrical contact therewith.

15. The light emitting accessory for jewelry of claim 12, further comprising:

a current interrupting device preventing the flow of electrical current to said at least one light emitting device in a periodic fashion, the interruption of current causing said light emitting device to flash.

* * * * *